US006454882B1

(12) United States Patent
Martin

(10) Patent No.: US 6,454,882 B1
(45) Date of Patent: Sep. 24, 2002

(54) TITANIUM ALLOY HAVING ENHANCED NOTCH TOUGHNESS

(75) Inventor: Patrick Lyle Martin, Auburn, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/760,695

(22) Filed: Jan. 16, 2001

Related U.S. Application Data

(62) Division of application No. 09/373,900, filed on Aug. 12, 1999, now Pat. No. 6,190,473.

(51) Int. Cl.[7] ..... C22C 14/00
(52) U.S. Cl. ..... 148/421; 148/672; 420/420
(58) Field of Search ..... 148/421, 672; 420/420

(56) References Cited

U.S. PATENT DOCUMENTS

| | | | | |
|---|---|---|---|---|
| 4,505,764 | A | | 3/1985 | Smickley et al. |
| 4,622,079 | A | | 11/1986 | Chang et al. |
| 4,624,714 | A | | 11/1986 | Smickley et al. |
| 4,631,092 | A | | 12/1986 | Ruckle et al. |
| 4,680,063 | A | | 7/1987 | Vogt et al. |
| 4,714,587 | A | * | 12/1987 | Eylon et al. ..... 419/25 |
| 4,820,360 | A | | 4/1989 | Eylon et al. |
| 4,832,760 | A | | 5/1989 | Eylon et al. |
| 4,872,927 | A | | 10/1989 | Eylon et al. |
| 4,898,624 | A | | 2/1990 | Chakrabarti et al. |
| 4,975,125 | A | | 12/1990 | Chakrabarti et al. |
| 5,032,189 | A | | 7/1991 | Eylon et al. |
| 5,173,134 | A | | 12/1992 | Chakrabarti et al. |
| 5,219,521 | A | | 6/1993 | Adams et al. |
| 5,256,369 | A | | 10/1993 | Ogawa et al. |
| 5,328,530 | A | | 7/1994 | Semiatin et al. |
| 5,332,545 | A | | 7/1994 | Love |
| 5,342,458 | A | | 8/1994 | Adams et al. |
| 5,366,570 | A | | 11/1994 | Mazur et al. |
| 5,399,212 | A | | 3/1995 | Chakrabarti et al. |
| 5,458,705 | A | | 10/1995 | Mazur et al. |
| 5,580,403 | A | | 12/1996 | Mazur et al. |
| 5,624,505 | A | | 4/1997 | Mazur et al. |
| 5,630,890 | A | | 5/1997 | Smashey et al. |
| 5,753,053 | A | | 5/1998 | Smashey et al. |

FOREIGN PATENT DOCUMENTS

| | | |
|---|---|---|
| EP | 0 487 803 A1 | 6/1992 |
| EP | 1141409 | 10/2001 |
| JP | 10306335 | 11/1998 |

* cited by examiner

*Primary Examiner*—John Sheehan
*Assistant Examiner*—Andrew L. Oltmans
(74) *Attorney, Agent, or Firm*—Alston & Bird LLP

(57) ABSTRACT

A titanium alpha-beta alloy having enhanced notch toughness comprises titanium, aluminum, and vanadium and is characterized by a microstructure having equiaxed alpha grains whose volume fraction is about 75 to 85 percent, a maximum grain size of the microstructure not exceeding about 10 $\mu$m, and with the volume fraction of primary alpha grains not exceeding about 2 percent.

2 Claims, 6 Drawing Sheets

TITANIUM ALLOY HAVING ENHANCED NOTCH TOUGHNESS

CROSS-REFERENCE TO RELATED APPLICATIONS

This application is a divisional application of U.S. application Ser. No. 09/373,900, filed Aug. 12, 1999 now U.S. Pat. No. 6,190,473.

FIELD OF THE INVENTION

The present invention relates to titanium metallurgy. The invention relates more particularly to processes for treating titanium alloys to enhance physical and mechanical properties of the alloys, such as ultimate tensile strength, notched tensile strength, and fatigue resistance, particularly at cryogenic temperatures.

BACKGROUND OF THE INVENTION

Titanium alloys are frequently used in aerospace and aeronautical applications because of the superior strength, low density, and corrosion resistance of titanium alloys. Titanium and its alloys exhibit a two-phase behavior. Pure titanium exists in an alpha phase having a hexagonal close-packed crystal structure up to its beta transus temperature (about 1625° F.). Above the beta transus temperature, the structure changes to the beta phase having a body-centered-cubic crystal structure. Pure titanium is quite weak and highly ductile, but can achieve high strength and workable ductility when alloyed with other elements. Certain alloying elements also affect the behavior of the crystal structure, causing the alloy to behave either as an alpha or near-alpha alloy or as an alpha-beta alloy at room temperature. Alpha-beta alloys are made by adding one or more beta stabilizers, such as vanadium, which inhibit the transformation from beta to alpha and depress the beta transus temperature such that the alloy exists in a two-phase alpha-beta form at room temperature. Alpha alloys are made by adding one or more alpha stabilizers, such as aluminum, which raise the beta transus temperature and stabilize the alpha form such that the alloy is predominately in the alpha form at room temperature.

Two basic types of titanium alloys are currently in use in the rocket propulsion industry: Ti-6-4, an alpha-beta alloy consisting principally of about 6 percent aluminum, 4 percent vanadium, and the balance titanium and incidental impurities;

and Ti-5-2.5, a near-alpha alloy consisting principally of about 5 percent aluminum, 2.5 percent tin, and the balance titanium and incidental impurities. The Ti-6-4 alloy is more readily available and is more easily processed to final form than the Ti-5-2.5 alloy, making, Ti-6-4 much less costly than Ti-5-2.5.

Very low-temperature applications, such as for hydrogen fuel pumps or the like, impose severe restrictions on the types of alloys that can be used, primarily because the notch sensitivity of an alloy can be degraded to unacceptable levels at such temperatures. Of the currently available commercially produced alloys, Ti-5-2.5 ELI (Extra Low Interstitial grade processed to have reduced incidence of interstitial impurities) is currently the alloy of choice for cryogenic temperature applications because of its relatively high ultimate strength (on the order of 210 ksi) and its relatively high notch tensile ratio or NTR (on the order of 1.1) at liquid hydrogen temperatures of about 20K. The NTR is defined as the ultimate tensile strength of a notched test specimen divided by the ultimate tensile strength of a smooth test specimen, and is a standard measure of the notch sensitivity of a material. The more common, stronger, and less costly Ti-6-4 ELI alloy is known to have poor ductility and be notch sensitive (i.e., its NTR is less than 1.0) at cryogenic temperatures of 77K and below, and thus is a less favorable choice.

It would be desirable, however, to be able to use the stronger Ti-6-4 alloy in cryogenic and other applications, rather than the Ti-5-2.5 alloy, because Ti-6-4 is significantly less costly. Additionally, there is typically a very long, lead time for purchase of Ti-5-2.5 ELI because there currently are only two known significant domestic users of this alloy. Accordingly, use of Ti-6-4 would enable quicker turnaround times. Furthermore, it would be desirable to provide a titanium alloy having improved ultimate strength compared to both Ti-5-2.5 and standard Ti-6-4, and having an acceptable NTR, preferably at least 1.0, at cryogenic temperatures. To achieve these ends, however, a non-standard processing of the standard Ti-6-4 alloy would be required in order to improve the strength and NTR at cryogenic temperatures.

It is known from the Hall-Petch relationship in physical metallurgy that decreasing the grain size results in an increase in strength. There is no known generally applicable correlation between grain size and NTR in alpha-beta titanium alloys, and very little data are available on how the properties of alpha-beta alloys behave as a function of grain size at cryogenic temperatures. There are some data to suggest, however, that at least in steels, an equiaxed grain size reduction can lead to both an increase in strength and an increase in fracture toughness.

Standard mill practice for Ti-6-4 bar calls for forging to occur at a temperature where the alloy is in the 2-phase alpha-beta field. The primary alpha that exists at these temperatures, typically in the range of 1600 to 1750° F., pins the beta grains during the deformation and leads to an initial grain size refinement. Following forging, the alloy is cooled to room temperature, which results in the decomposition of the high temperature beta grains to a lenticular mixture of alpha and beta through nucleation and growth processes. Thus, the final microstructure consists of relatively large "primary" alpha grains, on the order of 10 to 50 $\mu$m, and a fine mixture of alpha and beta plates whose scale is dependent on cooling rate (i.e., finer as the cooling rate increases).

One method for attaining finer grain sizes would be to use dynamic recrystallization during hot working. This is the process that leads to the initial refinement of the beta grains during conventional forging of alpha-beta alloys described above. However, the alpha grains do not change size during conventional forging and they do not undergo recrystallization with increased strain. Accordingly, it is impossible to attain a uniform fine grain size with the conventional forging process for Ti-6-4 because of the presence of the primary alpha grains.

SUMMARY OF THE INVENTION

The present invention provides a unique titanium alpha-beta alloy and a process for treating an alpha-beta titanium alloy, such as Ti-6-4, which leads to a high ultimate strength and notch tensile ratio of 1.0 or greater at cryogenic temperatures. The process is based on the unexpected discovery that a high strength and an optimum notch tensile ratio at cryogenic temperatures are attained by a microstructural arrangement of equiaxed alpha grains and a beta phase predominately in the form of a non-equiaxed distribution surrounding the alpha grains, the microstructure having a maximum grain size of about 5 to 10 μm, and the volume fraction of alpha being about 75 to 85 percent. Grain sizes below and above the 5 to 10 μm scale lead to less than optimum notch tensile ratios. The required microstructure cannot be achieved using conventional titanium processing techniques.

In accordance with the present invention, a billet of alpha-beta titanium alloy is processed by first causing a transformation of the alloy to a substantially single-phase beta microstructure, then causing a martensitic transformation of the single-phase beta microstructure to produce a fine platelet alpha-beta microstructure. Thereafter, the billet is isothermally forged at a temperature about 300° C. below the beta transus temperature of the alloy so as to attain a fine equiaxed microstructure such that a maximum grain size is on the order of about 2–5 μm. After forging, the billet is aged at a temperature slightly below the beta transus temperature, preferably about 25° C. to 75° C. below the beta transus temperature, for a period of time sufficient to grow the refined microstructure such that a maximum grain size is on the order of about 5–10 μm. Preferably, for Ti-6-4 ELI alloy having a beta transus of about 1000° C., the billet is aged at about 925° C. to about 975° C. for about 30–60 minutes so as to grow the scale of the refined equiaxed microstructure by a factor of about 2.

When applied to a conventional Ti-6-4 ELI alloy, the process in preferred embodiments leads to notch tensile ratios of greater than 1.0 and ultimate tensile strengths of 240–250 ksi at temperatures of 4K and 20K. Furthermore, the resulting alloy has been found to have an improved high-cycle fatigue resistance at 4K relative to conventionally processed Ti-5-2.5 alloy.

In accordance with a preferred embodiment of the invention, the transformation to the substantially single-phase beta microstructure is accomplished by solution treating the billet at a temperature near or above the beta transus temperature of the alloy. For example, for Ti-6-4, which has a beta transus temperature of about 1000° C., the billet is solution treated at a temperature in a range from about 990° C. to about 1020° C. for about 30 minutes.

The martensitic transformation of the beta alloy is accomplished preferably by cooling the billet at a rate in excess of air cooling to a temperature substantially below the beta transus temperature. For example, the billet can be quenched to about room temperature, such as by quenching in a liquid coolant, to induce a transformation of the single-phase beta microstructure to a predominately martensitic microstructure.

The isothermal forging operation is an important aspect of the process, enabling refinement of the fine platelet structure that results from the martensitic transformation. As noted above, the isothermal forging is conducted at a temperature substantially lower than the beta transus temperature, preferably about 300° C. lower than the beta transus. For Ti-6-4 alloy, the forging is carried out preferably at about 700° C. Advantageously, the billet is isothermally forged at a strain rate not greater than about 0.10 in/in/second. The total strain produced preferably should be in a range from about 0.5 to 0.8. For Ti-6-4, the total strain more preferably should be in a range from about 0.6 to 0.7.

A preferred process in accordance with the present invention has been used to treat conventional Ti-6-4 ELI alloy, leading to notch tensile ratios in excess of 1.0 and significant improvements in strength over both conventional T-6-4 ELI and Ti-5-2.5 ELI at cryogenic temperatures. It is anticipated, however, that the process should be advantageous for any alpha-beta titanium alloy.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Several different sets of commercially obtained Ti-6-4 ELI material were produced and tested to determine material properties including ultimate tensile strength (UTS), notched tensile strength from which the notch tensile ratio (NTR) was calculated, and percent elongation from initial yield to failure. All of the Ti-6-4 ELI used was taken from the same heat of 4-inch diameter GFM bar provided by President Titanium. Its chemical composition met the ASTM-F-136 specification and had a heat analysis of Ti-6.1A1-4.0V-0.2Fe-0.1C-0.11Oxygen (weight percent);

A baseline test was performed to determine the material properties of the conventionally processed Ti-6-4 ELI material as it was received. Test specimens were prepared and were tested in a tensile test machine at a temperature of 20K, and the results are tabulated in Table 1 below:

TABLE 1

20 K tensile properties of as-received Ti-6-4 ELI.

| Configuration | Yield Stress (ksi) | Ultimate Stress (ksi) | Elongation (%) | # of tests in average | NTR |
|---|---|---|---|---|---|
| As-received Ti-6-4 ELI: | | | | | |
| Smooth | 246.2 | 259.7 | 14 | 3 | |
| Notched | — | 241.1 | — | 2 | 0.96 |

Figure 1:
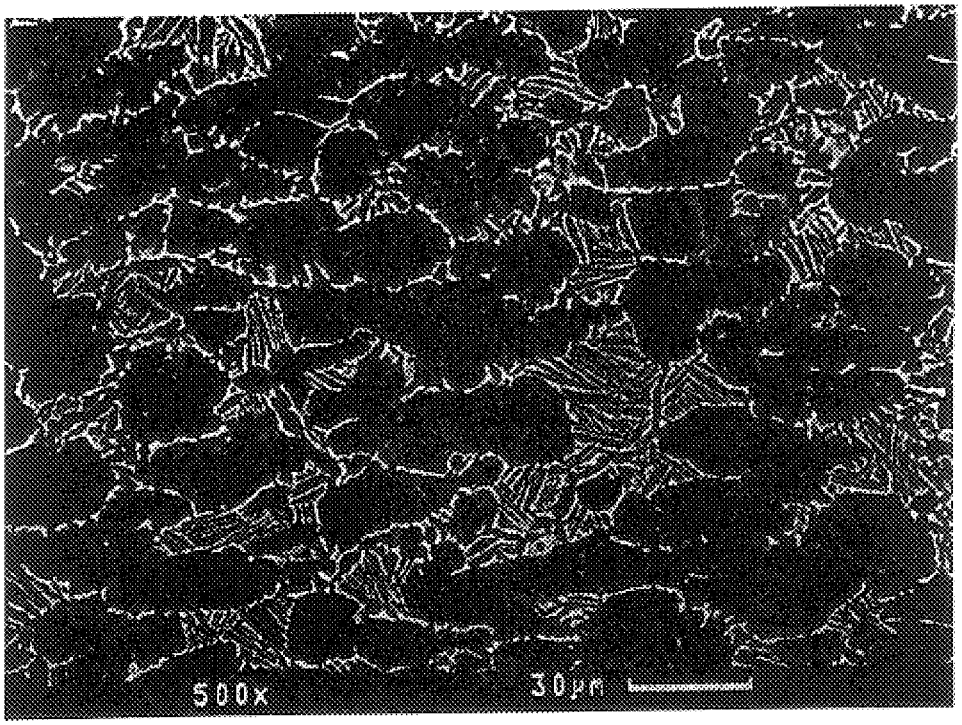
FIG. 1 a Scanning Electron Micrograph-Backscattered Electron Image (SEM-BEI) of an unetched specimen of conventionally processed Ti-6-4 alloy ELI alloy as received from the supplier.

FIG. 1 shows a Scanning Electron Micrograph-Backscattered Electron Image (SEM-BEI) of an unetched specimen of the conventionally processed Ti-6-4 alloy ELI alloy as received from the supplier. It can be seen that the microstructure is characterized by relatively large grain sizes and non-equiaxed structure.

A number of 2-inch thick forging preforms were prepared from the as-received Ti-6-4 ELI bar stock, and the preforms were processed using the following process, herein referred to as Process A:

1. Solution treat the preforms in the beta phase field at 1000° C. for 30 minutes and water quench to about room temperature.
2. Isothermally forge the preforms after a minimal time (approximately 15 minutes) on the hot dies. During the isothermal forging, the thickness of the billet was reduced to a thickness of about 0.6 inch (i.e., a total strain of about 0.7) at a temperature of 700° C. and an approximate strain rate of 0.05 in/in/sec.
3. Age the isothermally forged preforms at 950° C. (1750° F.) for 30 minutes (followed by air cooling to room temperature) such that the largest microstructural unit is on the order of about 10 $\mu$m.

Specimens for tensile testing were prepared from the preforms processed by the above process, and were tested at a temperature of 20K to determine the properties as noted above. The test results are given in Table 2 below:

TABLE 2

20 K tensile properties of Ti-6-4 ELI processed using Process A.

| Configuration | Yield Stress (ksi) | Ultimate Stress (ksi) | Elongation (%) | # of tests in average | NTR |
|---|---|---|---|---|---|
| Smooth | 233.8 | 245.7 | 12 | 5 | |
| Notched | — | 266.4 | — | 5 | 1.08 |

The tests were repeated at a temperature of 4K, and the results are given in Table 3 below:

TABLE 3

4 K tensile properties of Ti-6-4 ELI processed using Process A.

| Configuration | Yield Stress (ksi) | Ultimate Stress (ksi) | Elongation (%) | # of tests in average | NTR |
|---|---|---|---|---|---|
| Smooth | 240.6 | 246.9 | 11 | 2 | |
| Notched | — | 271.9 | — | 2 | 1.10 |

It can be seen by comparing Table 2 with Table 1 that Process A leads to a substantial improvement in the cryogenic notch tensile ratio relative to conventional Ti-6-4 ELI, and the data in Table 3 show that the notch tensile ratio remains excellent even down to 4K. Additionally, the smooth bar ultimate tensile strength is nearly the same as that of conventional Ti-6-4 ELI.

Figure 2:
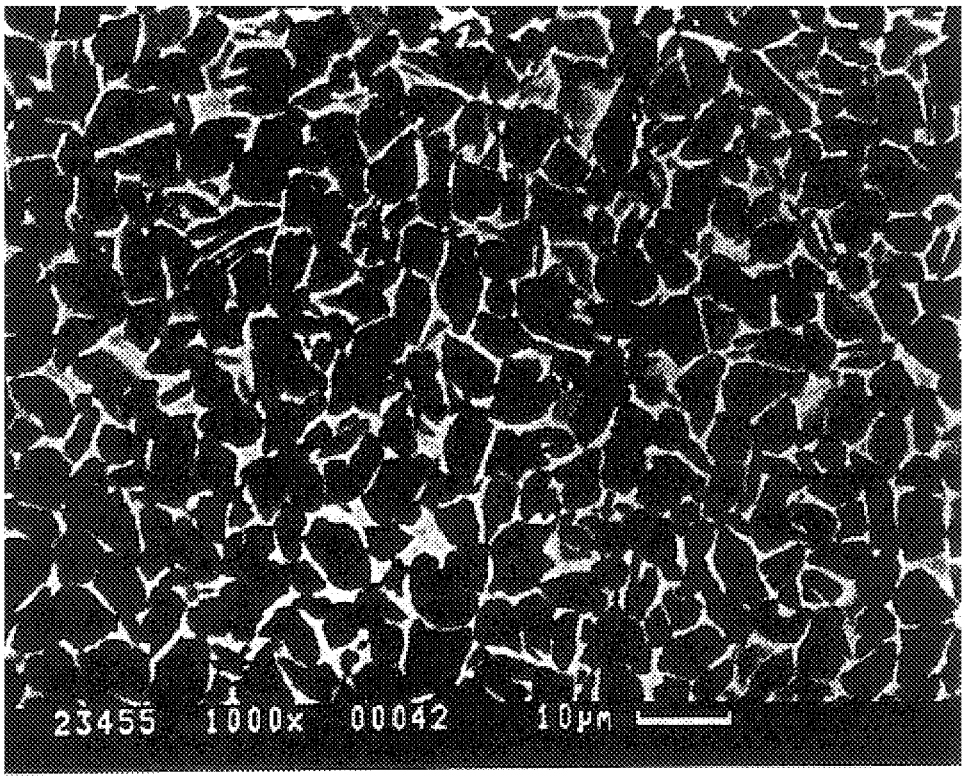
FIG. 2 is a SEM-BEI of an unetched specimen of Ti-6-4 alloy prepared by a Process A comprising solution treatment at 1000° C. for 30 minutes with water quench to about room temperature, followed by isothermal forging at 700° C. to a total strain of about 0.7, and aging the forged material at about 950° C. for 30 minutes.

FIG. 2 is a Scanning Electron Micrograph-Backscattered Electron Image (SEM-BEI) of an unetched specimen of Ti-6-4 ELI alloy produced in accordance with the above Process A. The alpha grains are visible as the gray or black regions, and the beta phase appears white. It can be seen that the grain structure displays fine equiaxed grains of alpha and a beta phase that appears predominately as a non-equiaxed distribution surrounding the grain boundaries of the alpha grains. The micrograph of FIG. 2 was used to compute the volume fraction of the beta phase by the quantitative metallography method, using over 1270 points in a 3-inch by 4-inch area. The estimated volume fraction of beta was found to be about 21 percent, and thus the alpha volume fraction is about 79 percent.

There are several variables that potentially can alter the results attained using Process A. Accordingly, each of the following variations was experimentally investigated:

1. Lower solution treatment temperature.
2. Lower cooling rate after the solution treatment.
3. Higher or lower final aging temperature.
4. Higher isothermal forging temperature.
5. Lower forging strain.

Test specimens were prepared and tested for each of the above variations, and the results are given below. In each case, comparison of the properties should be made to the properties of the alloy achieved by the Process A shown above in Tables 2 and 3, especially to the smooth bar ultimate strength and the NTR.

Figure 3:
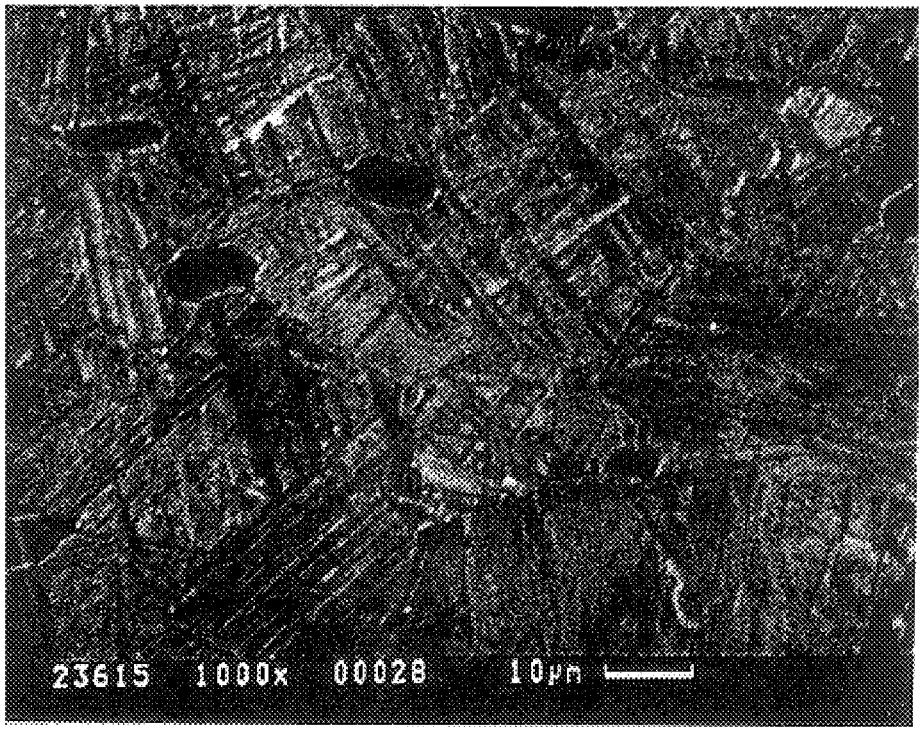
FIG. 3 is a SEM-BEI of an unetched specimen of Ti-6-4 alloy prepared by a process comprising solution treatment at 990° C. with water quench to about room temperature.
Figure 4:
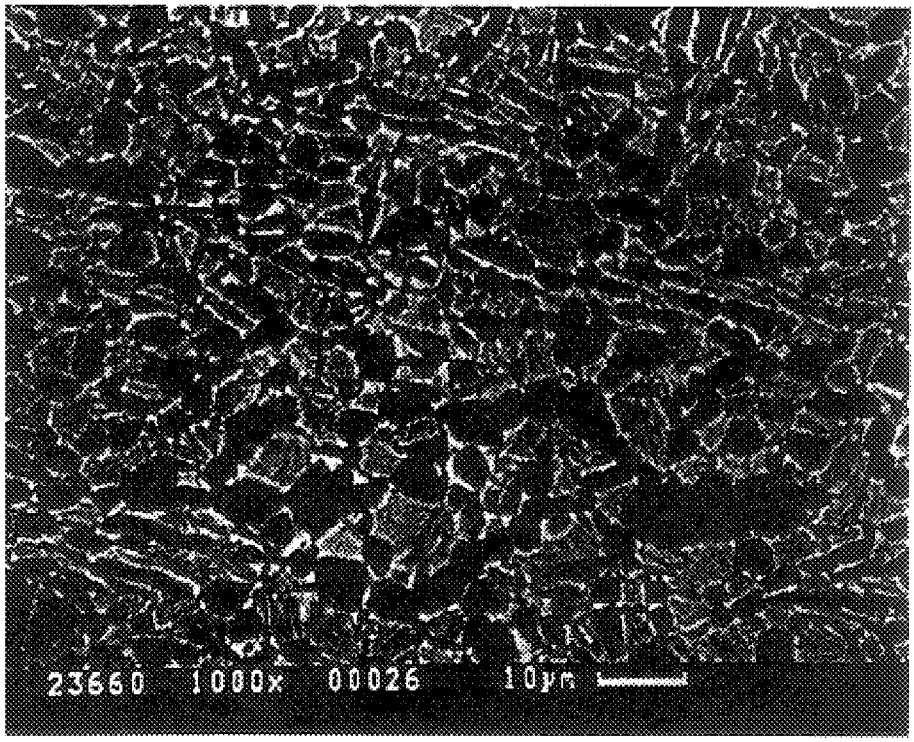
FIG. 4 is a SEM-BEI of an unetched specimen of Ti-6-4 alloy prepared by a process comprising solution treatment at 990° C. with water quench to about room temperature, followed by isothermal forging at 700° C. and aging at about 950° C. for 30 minutes (i.e., Process A except for solution treatment of 990° C.)

1. Effect of Lower Solution Treatment Temperature:

When Ti-6-4 ELI is solution treated at 990° C., a finite volume fraction (approximately 1%) of primary alpha is in equilibrium with the beta grains. When rapidly quenched, these alpha grains are embedded in a matrix of martensticially transformed beta. FIG. 3 shows a SEM-BEI of an unetched specimen of Ti-6-4 ELI alloy produced by solution treatment at 990° C. for 30 minutes followed by water quench (i.e., no isothermal forging or aging treatments). The primary alpha grains (black or gray in the micrograph) are clearly visible as distinct 10 to 15 $\mu$m grains. As FIG. 4 illustrates, even after isothermally forging the material of FIG. 3 at 700° C. and acing the material at 954° C. (1750° F.), these primary alpha grains remain. Even lower solution treatment temperatures below 990° C. would be expected to lead to an even larger volume fraction of primary alpha and a correspondingly greater effect on the properties of the alloy.

Specimens were prepared from a batch of Ti-6-4 ELI processed according to the above Process A, except with a solution treatment temperature of 990° C. rather than 1000° C. FIG. 4 shows the microstructure of the resulting material. The following average tensile properties of the specimens were measured at 20K:

TABLE 4

20 K tensile properties of Ti-6-4 ELI processed by Process A except with solution treatment temperature of 990° C.

| Configuration | Yield Stress (ksi) | Ultimate Stress (ksi) | Elongation (%) | # of tests in average | NTR |
|---|---|---|---|---|---|
| Smooth | 239.5 | 243.9 | 19 | 2 | |
| Notched | — | 272.0 | — | 2 | 1.11 |

These data indicate that there are no major losses in properties when a small amount of primary alpha is present in the forging preform. It is expected, however, that larger amounts of primary alpha would tend to drive the properties of the alloy toward those of conventionally processed Ti-6-4 ELI. Thus, preferably the material should include no more than about 2 percent primary alpha grains.

It should also be noted that solution treatment temperatures greater than 1000° C. are expected to produce results similar to solution treatment at 1000° C. As long as the solution treatment occurs near or above the beta transus temperature for the alloy, the material can be transformed into a substantially pure beta phase. The solution treatment temperature affects the growth kinetics of the beta grains in a single-phase beta material. Additionally, the amount of time spent near or above the beta transus temperature affects the resultant beta grain sizes. For a given duration of solution treatment, higher solution treatment temperature tends to grow the beta grains to larger scales. Likewise, for a given solution treatment temperature, a longer treatment duration tends to grow the beta grains to larger scales. In general, it is advantageous to keep the grain size as small as possible while still assuring that virtually all alpha grains are dissolved. In accordance with the present invention, therefore, the solution treatment is carried out at a temperature near or above the beta transus temperature for a period of time sufficient to dissolve substantially all alpha grains. For instance, for Ti-6-4 alloys, a preferred range of solution treatment temperature is about 990–1020° C., and a preferred duration is about 30 minutes. However, it will be appreciated based on the above reasoning that the time/temperature relationship involves a trade-off, and hence somewhat different temperatures and/or treatment durations can be used.

2. Effect of Cooling Rate:

The relatively rapid cooling that results from water quenching the preforms to room temperature in Process A leads to a fine mixture of alpha and beta that is amenable to refinement of the grain size in subsequent processing steps. When the cooling rate from the beta phase field is slowed, the tendency toward nucleation and growth of alpha competes with the martensitic transformation mechanism. Fortunately, however, it has been found that the material properties are not highly sensitive to the cooling rate. Two cooling rates slower than water quenching were investigated, namely, air cooling from 1000° C., and a "slow" cooling rate intermediate the water quench and air cooling rates. The slow cooling rate was tested from both 1000° C. and 990° C., and the results are tabulated in Table 5 below:

TABLE 5

20 K tensile properties of Ti-6-4 ELI cooled from 1000° C. and 990° C. at slower rates (relative to water quenched), otherwise processed by Process A.

| Configuration | Yield Stress (ksi) | Ultimate Stress (ksi) | Elongation (%) | # of tests in average | NTR |
|---|---|---|---|---|---|
| Sol'n at 1000° C. with air cool: | | | | | |
| Smooth | 240.4 | 243.2 | 12 | 2 | |
| Notched | — | 231.5 | — | 2 | 0.95 |
| Sol'n at 1000° C. with slow cool: | | | | | |
| Smooth | 226.4 | 238.7 | 16 | 2 | |
| Notched | — | 239.6 | — | 2 | 1.00 |
| Sol'n at 990° C. with slow cool: | | | | | |
| Smooth | 237.4 | 245.4 | 12 | 2 | |
| Notched | — | 270.3 | — | 2 | 1.10 |

Figure 5:
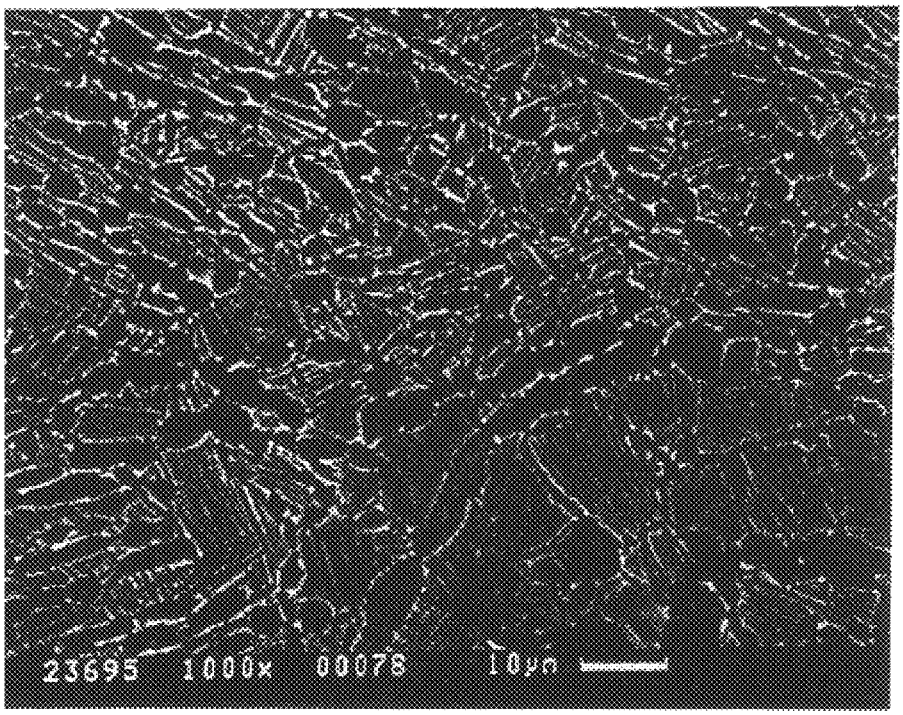
FIG. 5 is a SEM-BEI of an unetched specimen of Ti-6-4 alloy prepared by a process similar to Process A except for slow cooling rather than water quenching after the solution treatment.

It can be seen that air cooling leads to a substantial degradation in the properties, and thus a cooling rate in excess of air cooling is preferred. The cooling rate need not be as great as that provided by water quenching, however, as evidenced by the moderate drop-off in properties when slow cooling (Table 5) is used rather than water quenching (Table 2). FIG. 5 is a SEM-BEI of a specimen produced by solution treatment at 1000° C. followed by slow cooling, then isothermal forging at 700° C. and aging at 954° C. for 30 minutes (i.e., Process A except for slow cooling rather than water quench). Comparison of FIG. 5 with FIG. 2 shows that the scale of the microstructure is not greatly affected by the reduction in cooling rate. It can also be seen from the data in Table 5 that slow cooling produces notch tensile ratios that are superior to that of conventional Ti-6-4 ELI (Table 1). Thus, the relative insensitivity to cooling rate bodes well for scale-up to larger sizes of preforms where water quenching may not provide as great a cooling rate as those achieved with the 2-inch thick preforms that were tested.

3. Effect of Aging Temperature:

An extensive examination of final aging temperature was conducted to discern the effects of grain size on cryogenic properties. Aging temperatures from 870° C. to 980° C. were tested (the other process steps being as described in Process A), and the test results are given in Table 6 below:

TABLE 6

20 K tensile properties of Ti-6-4 ELI aged at different temperatures for 30 minutes, otherwise processed using Process A.

| Configuration | Yield Stress (ksi) | Ultimate Stress (ksi) | Elongation (%) | # of tests in average | NTR |
|---|---|---|---|---|---|
| Aged at 870° C. (1600° F.): | | | | | |
| Smooth | 244.6 | 251.3 | 11 | 1 | |
| Notched | — | 192.7 | — | 1 | 0.77 |
| Aged at 900° C. (1650° F.): | | | | | |
| Smooth | 238.9 | 247.4 | 9 | 2 | |
| Notched | — | 223.2 | — | 2 | 0.90 |

TABLE 6-continued

20 K tensile properties of Ti-6-4 ELI aged at different temperatures for 30 minutes, otherwise processed using Process A.

| Configuration | Yield Stress (ksi) | Ultimate Stress (ksi) | Elongation (%) | # of tests in average | NTR |
|---|---|---|---|---|---|
| Aged at 925° C. (1700° F.): | | | | | |
| Smooth | 240.4 | 253.1 | 10 | 4 | |
| Notched | — | 242.1 | — | 4 | 0.96 |
| Aged at 950° C. (1750° F.): | | | | | |
| Smooth | 233.8 | 245.7 | 12 | 5 | |
| Notched | — | 266.4 | — | 5 | 1.08 |
| Aged at 970° C. (1775° F.): | | | | | |
| Smooth | 242.1 | 243.9 | 13 | 2 | |
| Notched | — | 257.4 | — | 2 | 1.06 |
| Aged at 980° C. (1800 F.): | | | | | |
| Smooth | 229.9 | 240.8 | 7 | 2 | |
| Notched | — | 238.3 | — | 2 | 0.99 |

It can be seen that an optimum aging temperature exists somewhere in the vicinity of 950° C. to 970° C., and using an aging temperature below or above this level leads to reductions in the smooth bar strength and notch tensile ratio. Depending on the other process variables, it is believed that a preferred range of aging temperatures is about 925° C. to 970° C.

Figure 6:
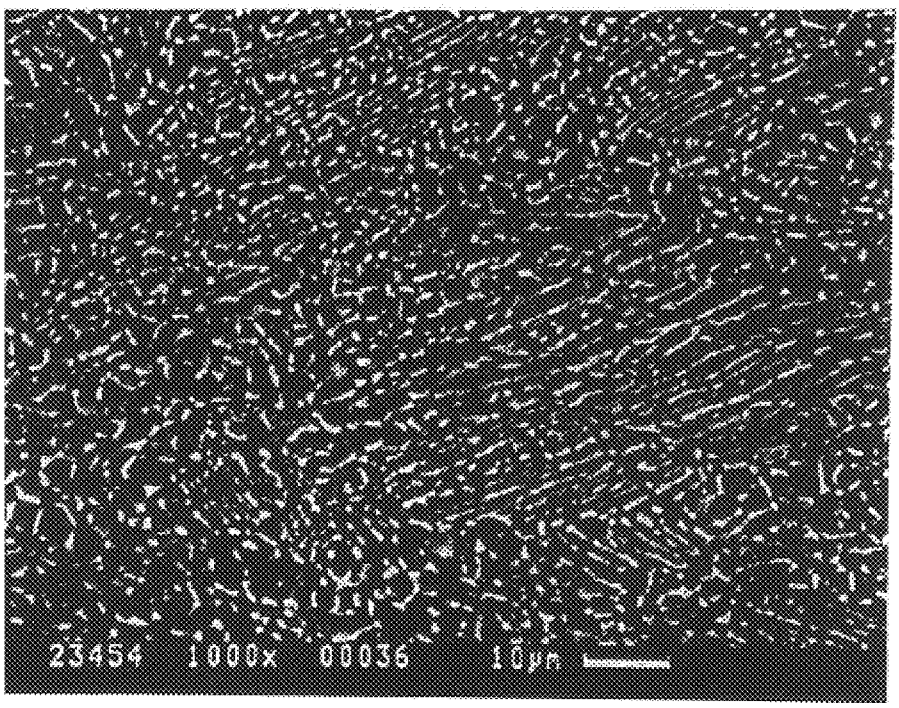
FIG. 6 is a SEM-BEI of an unetched specimen of Ti-6-4 alloy prepared by a process similar to Process A except for aging treatment at 870° C. rather than 950° C.

The aging temperature tends to correlate with the grain sizes that result from the aging treatment. At aging temperatures lower than 950–970° C., the grain sizes achieved tend to be smaller than those achieved at 950–970° C. For example, FIG. 6 is a SEM-BEI of a specimen produced in accordance with Process A except that the final aging temperature was 870° C. rather than 950° C. It can be seen that the specimen displays a finer scale of equiaxed microstructure compared to the baseline material produced by Process A (FIG. 2). It was noted previously that the alpha volume fraction produced at an aging temperature of 950° C. was about 79 percent. It is estimated that this volume fraction may vary by plus or minus 5 percent over the range of 925° C. to 970° C. aging temperatures. Thus, the preferred microstructure should have an alpha volume fraction of about 75 to 85 percent.

Figure 7:
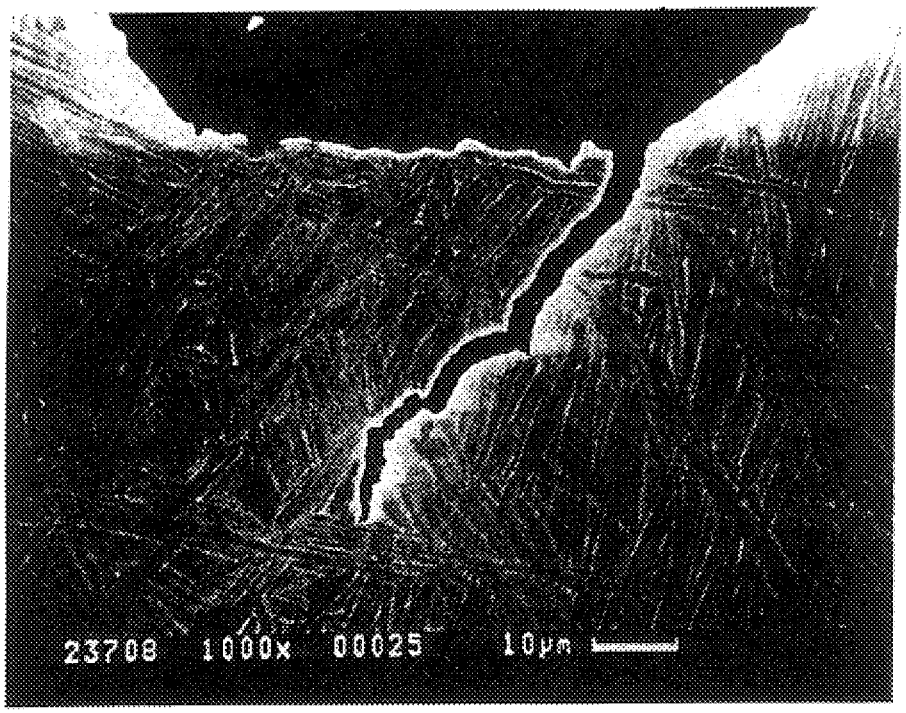
FIG. 7 is a SEM-BEI of an unetched specimen of Ti-6-4 alloy prepared by a process similar to Process A except for aging treatment at 980° C. rather than 950° C.

At final aging temperatures above 970° C., the grain sizes tend to be larger than for 950–970° C. At 980° C. and above, the volume fraction of lamellar alpha and beta (beta that transformed on cooling) increases. For example, FIG. 7 shows a specimen produced by Process A except with an aging temperature 980° C. rather than 950° C. The specimen displays a coarse lamellar microstructure compared to the baseline material of Process A. Thus, there is an optimum equiaxed grain size that is yielded by aging at 950–970° C.

It should also be noted that in all of the tests, the aging treatment was conducted for a period of about 30 minutes. This duration, in combination with the aging temperature of 950–970° C., was found to yield a microstructure in which the largest microstructural unit is on the order of about 5 to 10 $\mu$m. However, it should be noted that various combinations of aging temperatures and durations can be used for attaining the desired grain size of 5 to 10 $\mu$m. For a given aging temperature, a longer aging duration will lead to larger grain sizes. Likewise, for a given aging duration, a higher aging temperature will lead to larger grain sizes. The relevant consideration in the aging treatment is the grain size achieved, rather than the specific combination of time and temperature used to achieve that grain size. Thus, in accordance with the present invention, the aging treatment is carried out at a temperature below the beta transus temperature for a period of time sufficient to cause the 2-phase microstructure to grow to a grain size of 5 to 10 $\mu$m. For a Ti-6-4 alloy, the preferred aging temperature is 925–975° C. (i.e., 25 to 75° C. below the beta transus temperature) and the preferred duration is about 30 minutes.

Figure 8:
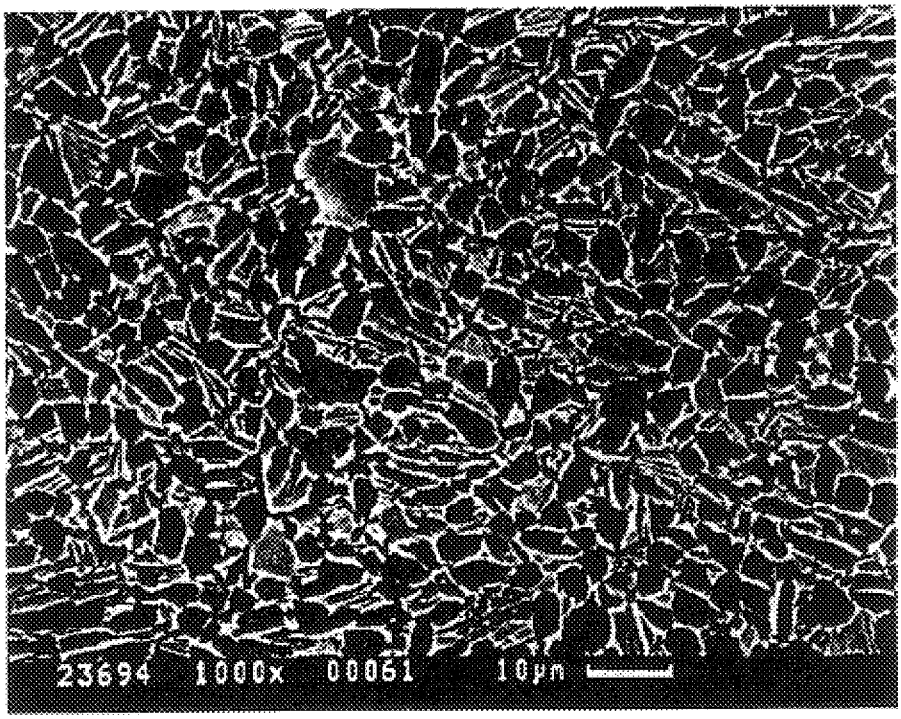
FIG. 8 is a SEM-BEI of an unetched specimen of Ti-6-4 alloy prepared by a process similar to Process A except for isothermal forging at 750° C. rather than 700° C.

4. Effect of Isothermal Forging Temperature:

A set of Ti-6-4 ELI preforms was prepared using Process A, except that the isothermal forging temperature was increased to 750° C. (i.e., about 250° C. below the beta transus temperature for Ti-6-4 ELI). FIG. 8 shows a specimen of the material produce by this process. It can be seen that the higher forging temperature results in a similar overall microstructure to that yielded by Process A employing a 700° C. forging temperature. However, this higher forging temperature nevertheless had a negative impact on the tensile properties as shown in Table 7 below:

TABLE 7

20 K tensile properties of Ti-6-4 ELI processed using Process A, except forged at 750° C. instead of 700° C.

| Configuration | Yield Stress (ksi) | Ultimate Stress (ksi) | Elongation (%) | # of tests in average | NTR |
|---|---|---|---|---|---|
| Smooth | 233.9 | 246.2 | 10 | 2 | |
| Notched | — | 209.4 | — | 2 | 0.85 |

It is believed that forging temperatures somewhat higher or lower than 700° C. could yield acceptable notch tensile ratios and smooth bar strengths depending on the other process variables, such as the total forging strain.

Figure 9:
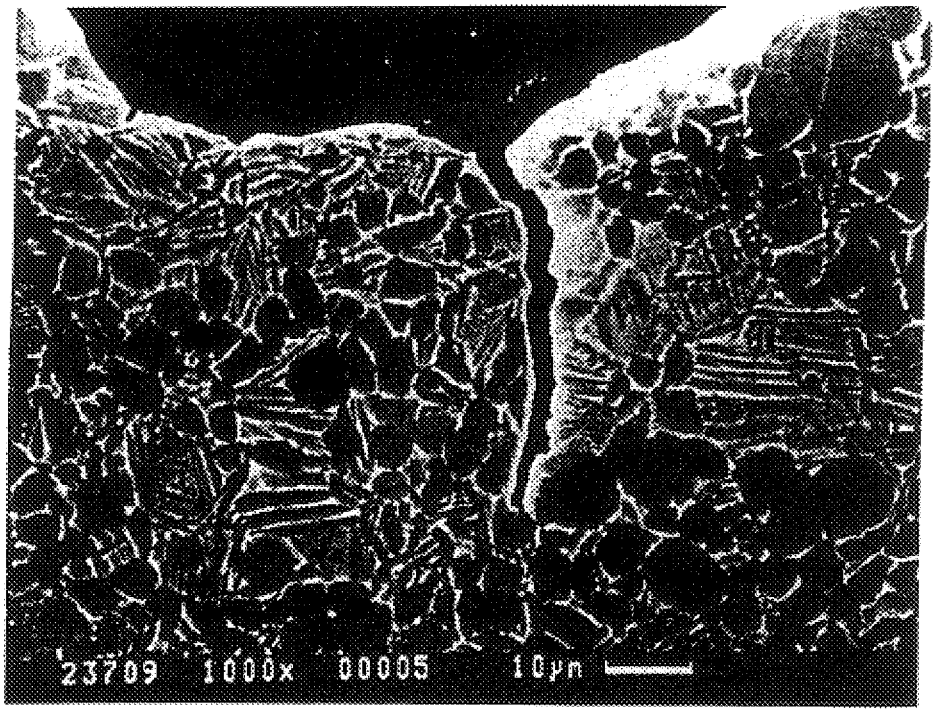
FIG. 9 is a SEM-BEI of an unetched specimen of Ti-6-4 alloy prepared by a process similar to Process A except for isothermally forging the billet to a total strain of 62% rather than 70%.

5. Effect of Forging Strain:

A batch of Ti-6-4 ELI alloy was processed using Process A, except that the forging operation was conducted so as to achieve a total strain of 62% rather than 70%. FIG. 9 shows a specimen of the material. The overall microstructure is similar to that attained by Process A. The tensile test results are given in Table 8 below:

TABLE 8

20 K tensile properties of Ti-6-4 ELI processed using Process A, except forged 62%.

| Configuration | Yield Stress (ksi) | Ultimate Stress (ksi) | Elongation (%) | # of tests in average | NTR |
|---|---|---|---|---|---|
| Smooth | 235.9 | 246.5 | 11 | 2 | |
| Notched | — | 245.5 | — | 2 | 1.00 |

It will be noted that the notch tensile ratio is significantly smaller than that achieved with Process A, although it is still acceptable. The smooth bar ultimate strength is nearly the same as that for Process A. Depending on the other process parameters, it is believed that a total strain of from about 50% to about 80% can be used, but more preferably the strain should be about 60% to 70%.

Figure 10:
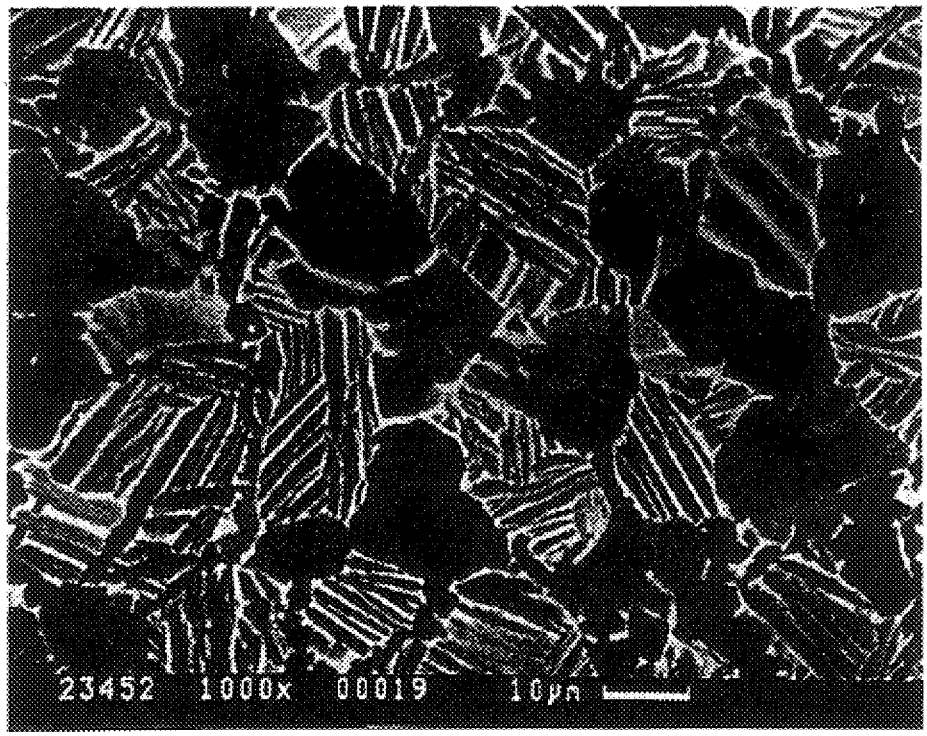
FIG. 10 is a SEM-BEI of an unetched specimen of Ti-6-4 alloy prepared by a process similar to Process A except that the solution treatment near or above the beta transus temperature is omitted before the isothermal forging and aging treatments.

Baseline Properties for Comparison:

In addition to testing the as-received Ti-6-4 ELI alloy, the results of which are given in Table 1 above, a batch of as-received Ti-6-4 ELI alloy was processed using only the forging and aging steps of Process A (i.e., the solution treatment and quench were omitted). FIG. 10 shows a specimen of the material thus produced. The scale of the microstructure is substantially greater than the baseline material of Process A. Tensile test results for this material are given in Table 9 below:

TABLE 9

20 K tensile properties of Ti-6-4 ELI forged at 700° C. followed by aging at 950° C. for 30 minutes.

| Configuration | Yield Stress (ksi) | Ultimate Stress (ksi) | Elongation (%) | # of tests in average | NTR |
|---|---|---|---|---|---|
| As-received Ti-6-4 ELI, forged and aged: | | | | | |
| Smooth | 230.9 | 242.5 | 13 | 3 | |
| Notched | — | 227.7 | — | 3 | 0.94 |

It can be seen that the NTR is inferior to that attained with Process A. Thus, the solution treatment and rapid cooling are important components of the overall process.

Figure 11:
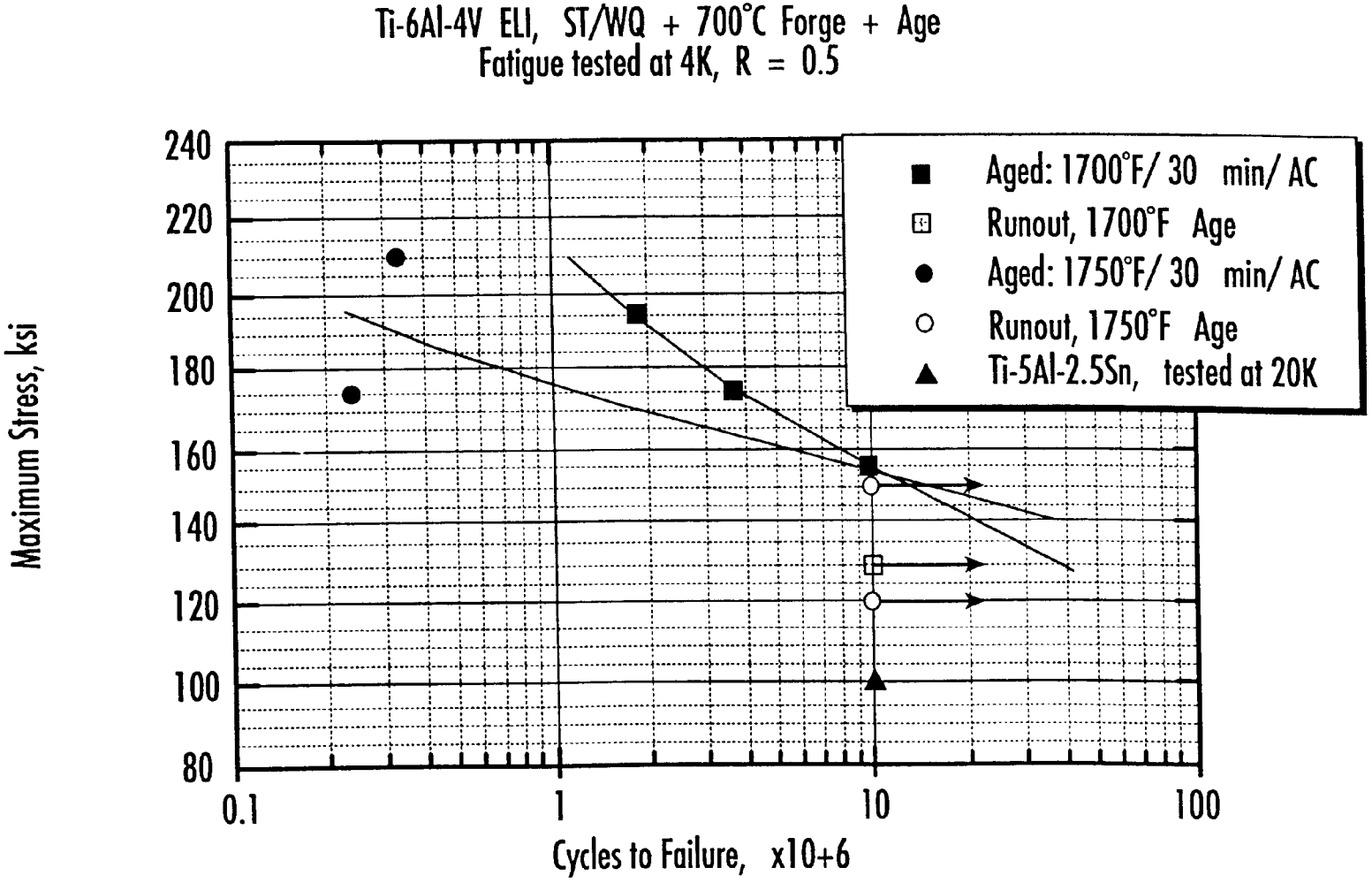
FIG. 11 is a plot of fatigue data derived from fatigue testing of several specimens of two titanium alloy materials produced by processes in accordance with the present invention and a conventional Ti-5-2.5 alloy.

Fatigue Performance:

A set of test specimens were prepared from Ti-6-4 ELI alloy processed using the Process A, and the specimens were fatigue tested at 4K (which was easier to control than 20K and was considered a more severe test of the Ti-6-4 ELI). Additionally, test specimens prepared from Ti-6-4 ELI processed using Process A except with an aging temperature of 925° C. were also fatigue tested. Both sets of specimens were tested using an R-ratio of 0.5 and various stresses to define the run-out at $10^7$ cycles (run-out being defined as the maximum cyclic stress where the specimen does not break at the specified number of cycles). The test results are plotted in FIG. 11. The run-out stress was 150 ksi for the 950° C. age and 130 ksi for the 925° C. age. For comparison, the run-out stress of Ti-5-2.5 ELI at the higher temperature of 20K (the run-out at 4K was not available), as indicated on FIG. 11, is 100 ksi. Thus, the Process A applied to Ti-6-4 ELI leads to at least a 50% increase in fatigue life relative to conventional Ti-5-2.5 ELI.

Based on the tests that were performed and the foregoing results, it appears that there is a preferred processing sequence that leads to cryogenic notch tensile ratios greater than 1.0 in alpha-beta titanium alloys such as Ti-6-4. The test data also show, however, that some variations in process parameters can be tolerated without substantial degradation in material properties. Accordingly, the process of the invention should lend itself to being used in production where highly precise control of process parameters may not always be possible or practical.

That the process of the present invention leads to a combination of superior properties is somewhat surprising. Based on what is known and/or what has been reported in the prior art about titanium microstructures and their relationships with material properties, an equiaxed microstructure for titanium generally is not considered to be a high-toughness condition. The improved NTR at cryogenic temperatures achieved by the present invention is therefore counter to this knowledge.

Many modifications and other embodiments of the invention will come to mind to one skilled in the art to which this invention pertains having the benefit of the teachings presented in the foregoing descriptions and the associated drawings. Therefore, it is understood that the invention is not limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A titanium alloy comprising titanium, aluminum, and vanadium, the alloy having an alpha-beta microstructure characterized by equiaxed alpha grains with a maximum grain size not exceeding about 10 $\mu$m and having less than about 2 percent primary alpha grains, the alpha grains having a volume fraction of about 75 to 85 percent.

2. The titanium alloy of claim 1, wherein the beta phase of the microstructure is predominately a non-equiaxed distribution surrounding the alpha grains.

* * * * *